US007318242B2

(12) United States Patent
Pace

(10) Patent No.: US 7,318,242 B2
(45) Date of Patent: Jan. 15, 2008

(54) TOILET/BIDET DEVICE

(76) Inventor: Edgar Alan Pace, 1140 Pace's Place Rd., Pinnacle, NC (US) 27043

( * ) Notice: Subject to any disclaimer, the term of this patent is extended or adjusted under 35 U.S.C. 154(b) by 0 days.

(21) Appl. No.: 11/325,207

(22) Filed: Jan. 5, 2006

(65) Prior Publication Data

US 2007/0151013 A1 Jul. 5, 2007

(51) Int. Cl.
*A47K 3/20* (2006.01)

(52) U.S. Cl. ..... 4/420.4; 4/420.5; 4/448; 4/443

(58) Field of Classification Search ..... 4/420.1–420.5, 4/443–448
See application file for complete search history.

(56) References Cited

U.S. PATENT DOCUMENTS 1,819,941 A * 8/1931 Brown ..... 604/114
2,826,761 A * 3/1958 Lazarus et al. ..... 4/447
3,570,015 A * 3/1971 Rosengaus ..... 4/420.4
4,041,553 A * 8/1977 Sussman ..... 4/447
5,101,520 A * 4/1992 Lockhart ..... 4/447
5,210,885 A * 5/1993 Ruo ..... 4/420.2
5,247,711 A * 9/1993 Kwon ..... 4/420.4
5,331,692 A * 7/1994 Alberti ..... 4/445
5,384,919 A * 1/1995 Smith ..... 4/448
5,987,659 A * 11/1999 Cannizzaro ..... 4/420.2

* cited by examiner

*Primary Examiner*—Khoa D. Huynh

(57) ABSTRACT

A bidet toilet attachment is connected to the main water line in the bathroom at a valve. The valve is connected on one side to a water flow handle and on the other side to a bidet hoop conduit. The hoop conduit carries water from the main water line when the valve is actuated and is movable from a first position flat under the seat to a second position below the seat opening. The hoop conduit has a nozzle near the middle of the toilet and extends to the other side of the toilet seat where it ends as a lever for moving the hoop conduit between its two positions. The handle is fixed so that when the hoop conduit moves with respect to the handle, the valve moves with respect to the handle and water flows through the valve, into the hoop conduit and out the nozzle for cleansing.

12 Claims, 6 Drawing Sheets

TOILET/BIDET DEVICE

BACKGROUND OF THE INVENTION

1. Field of the Invention

The present invention relates generally to hygienic fixtures and particularly to devices for attachment to toilet bowls for cleansing and irrigating the external genital and posterior areas of the user's body.

2. Description of the Prior Art

Bidets have been developed in a number of forms for the purpose of cleansing the genital and posterior areas of the body. In general, prior art bidets have a nozzle connected to a fluid source with the nozzle mounted over a catch basin. By sitting or squatting over the nozzle, a user can cleanse his or her genital or posterior region. Excess liquid is caught in the catch basin so it can be appropriately expelled.

Although conventional bidets such as those commonly used outside the United States are independent fixtures within a toilet, numerous devices have been developed so that the conventional toilet can be adapted for use as a bidet. One of the goals of such devices is to provide the function of the conventional bidet without the expense of a separate permanent fixture and without consuming additional floor within the bathroom.

It is also desirable that such devices be portable and universal. Optimum portability includes the ability to quickly attach and detach the device to and from the toilet so that it need not remain attached to the toilet when it will not be used for an extended period of time. Optimum portability also includes the ability to carry the device from one place to another. The device, therefore, should be light in weight and compact in size so that it can be carried discretely in a suitcase or the like without damage.

For optimum universality, the device must be readily attachable to essentially any toilet so that the toilet need not be modified to accommodate the device. Since the device may be in use for an extended period, the toilet must be usable for normal toilet functions while the device is attached.

It can be appreciated that there exists a continuing need for a new and improved bidet device incorporating the features set forth above and more including the provision of a warm water spray in connection with a conventional, existing toilet. The present invention is directed to this need.

SUMMARY OF THE INVENTION

The present invention is a device for performing the function of a bidet. It can be quickly attached to any conventional toilet, can be carried easily by one user from one location to another, can be adjusted according to a particular user's needs, and can remain in place while the toilet is used for ordinary toilet functions. The device is inexpensive, attractive, and easily cleaned.

The present invention is connected to the main water line coming into the bathroom and extends toward the toilet to engage a valve. The valve is connected on one side to a water-flow sensitive handle and on the other to a bidet hoop conduit. The bidet hoop conduit carries water from the main water line when the valve is actuated and is movable from a first position substantially flat against the under of the seat to a second position extending below the seat opening. A nozzle is operable attached to the bidet hoop conduit very near the middle of the toilet base. The bidet hoop conduit extends to the other side of the toilet seat where it ends as an operable lever for moving the bidet hoop conduit back and forth between the two positions. The water-flow sensitive handle is fixed (rotation not permitted) so that when the bidet hoop conduit moves from the first position to the second position, the valve moves with respect to the handle and water then flows through the valve, into the bidet hoop conduit and out through the nozzle for cleansing.

The invention also incorporates a spring which goes into tension when the bidet hoop conduit moves from the first to the second position and releases that tension when the lever is released to urge the bidet hoop conduit back to the first position.

A spiral wound pipe coil is positioned around the conduit just before the valve to accommodate a light bulb which serves to heat the water flowing through the coil on its way to the nozzle and thereby provide a warm comfortable water spray for the user.

It is an object of the invention to provide a combination toilet seat and bidet attachment which can be installed in a conventional bathroom simply by replacing the existing toilet seat and thus providing the advantages of owning a bidet while avoiding the expense and inconvenience of installing a separate bidet.

It is a further object of the invention to provide a more sanitary and easily cleaned combination toilet seat and bidet attachment than was heretofore available.

Thus there has been outlined the more important features of the invention in order that the detailed description that follows may be better understood and in order that the present contribution to the art may be better appreciate. There are, of course, additional features of the invention that will be described hereunder and which will form the subject matter of the claims appended hereto. In that respect. before explaining the at least one embodiment of the invention in detail, it is to be understood that the invention is not limited in its arrangement of the components set forth in the following description and illustrated in the drawings. The invention is capable of other embodiments and of being praticed and carried out in various ways.

It is also to be understood that the phraseology and terminology employed here are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither to define the invention of the application. which is measured by its claims, nor to limit its scope in any way.

Thus, the objectives of the invention set forth above, along with the various features of novelty which characterize the invention, are noted with particuiarity in the claims annexed to and forming a part of this disclosure. For a better understanding of the invention, its operating advantages and the specific results obtained by its use. reference should be made to the following detailed specification taken in conjunction with accompanying drawings wherein like characters of referenc designate like parts throughout the several views.

The drawings are included to provide a further understanding of the invention and are incorporated in and constitute a part of this specification. They illustrate embodiments of the invention and. together with their description, serve to explain the principles of the invention.

DETAILED DESCRIPTION OF THE PREFERRED EMBODIMENTS

Figure 1:
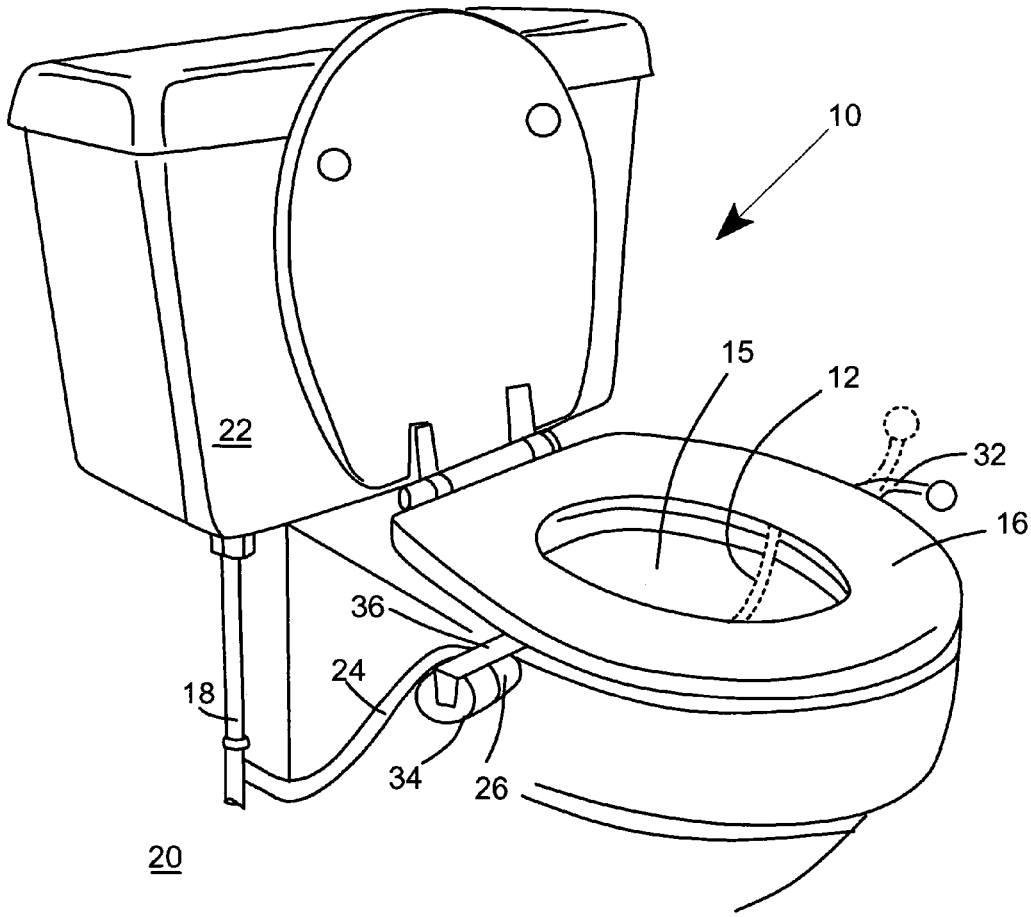
FIG. 1 is a perspective partial view of a toilet equipped with bidet device comprising the present invention.
Figure 2:
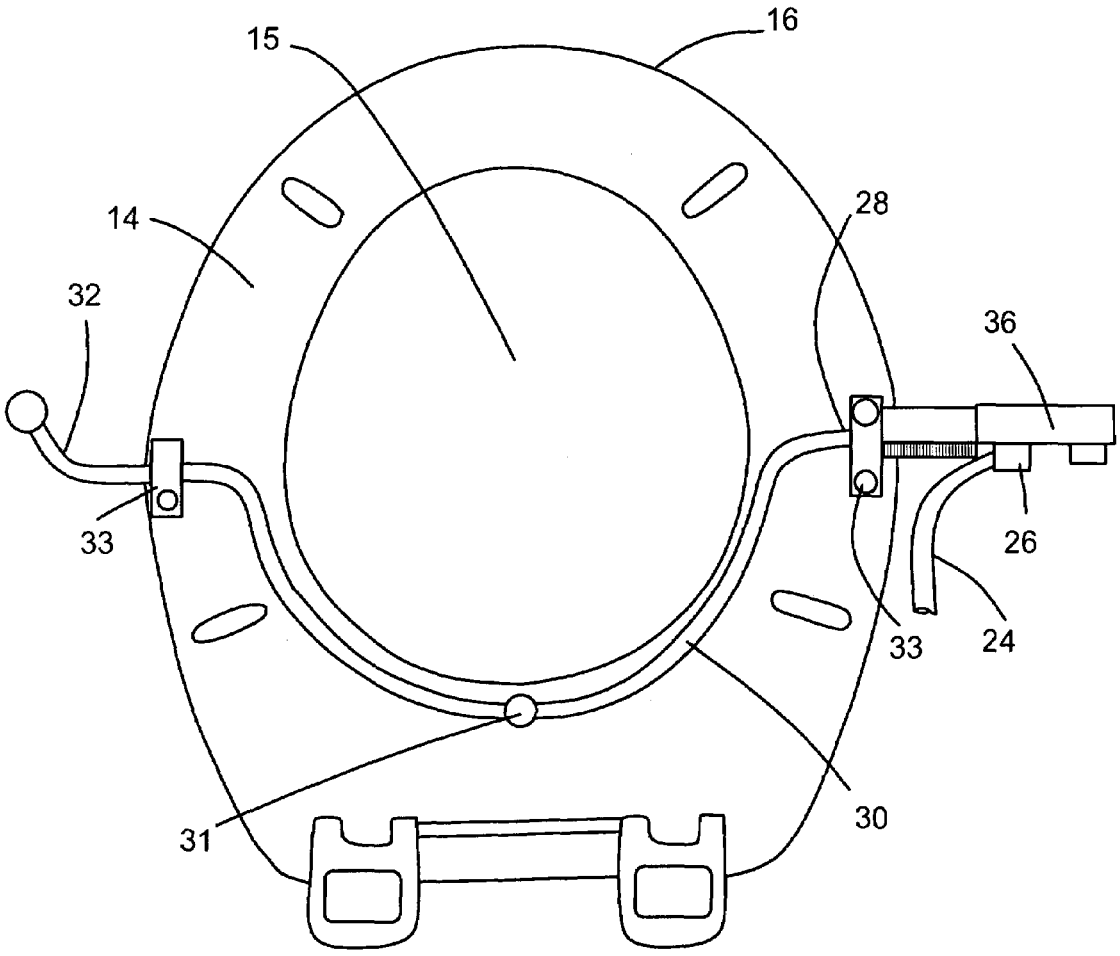
FIG. 2 is a plan view of the bottom of a toilet seat to which is affixed the device of the present invention.
Figure 3:
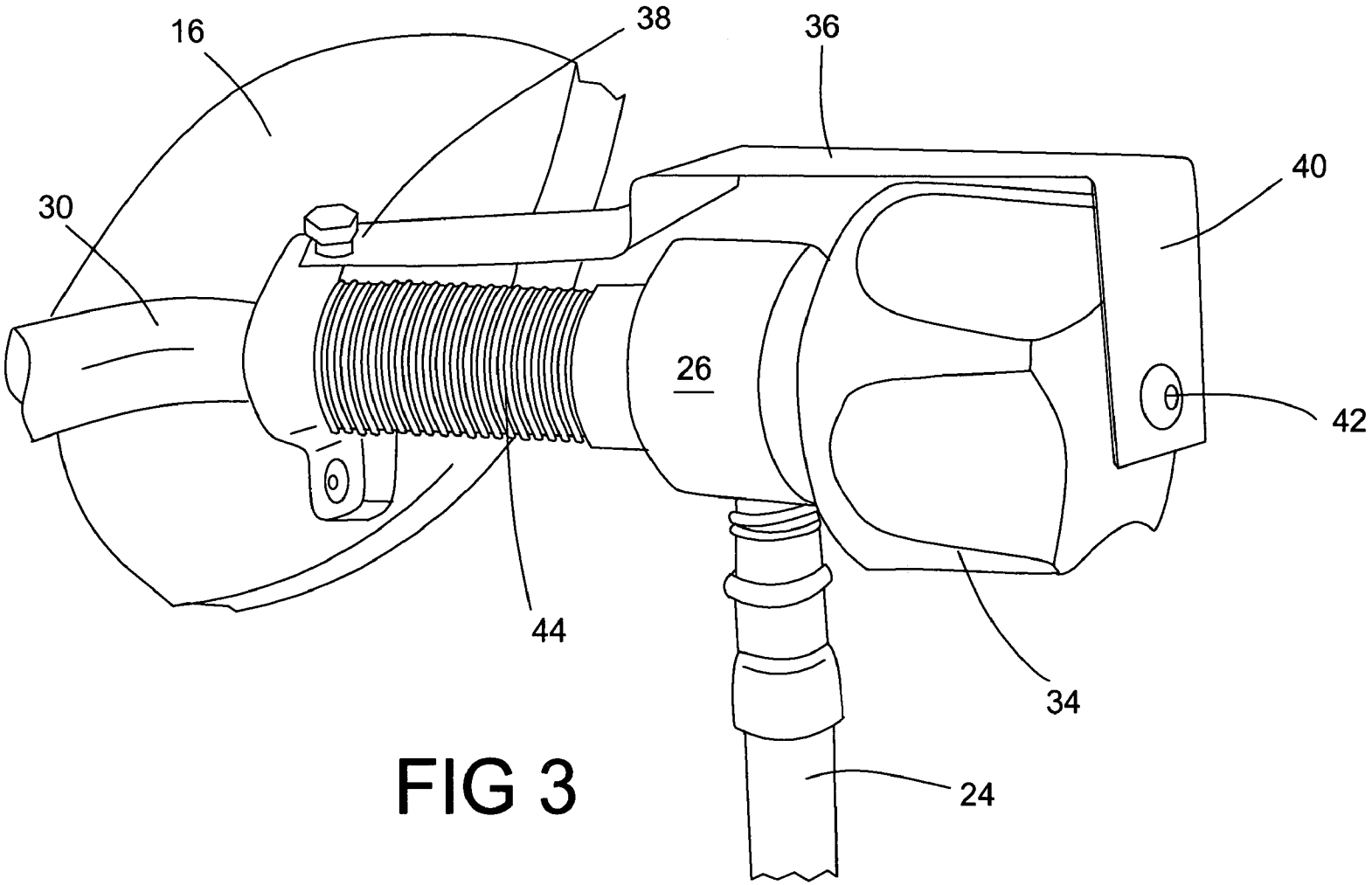
FIG. 3 is an enlarged, perspective view of the valve, handle, spring and bidet hoop device of the present invention.
Figure 4:
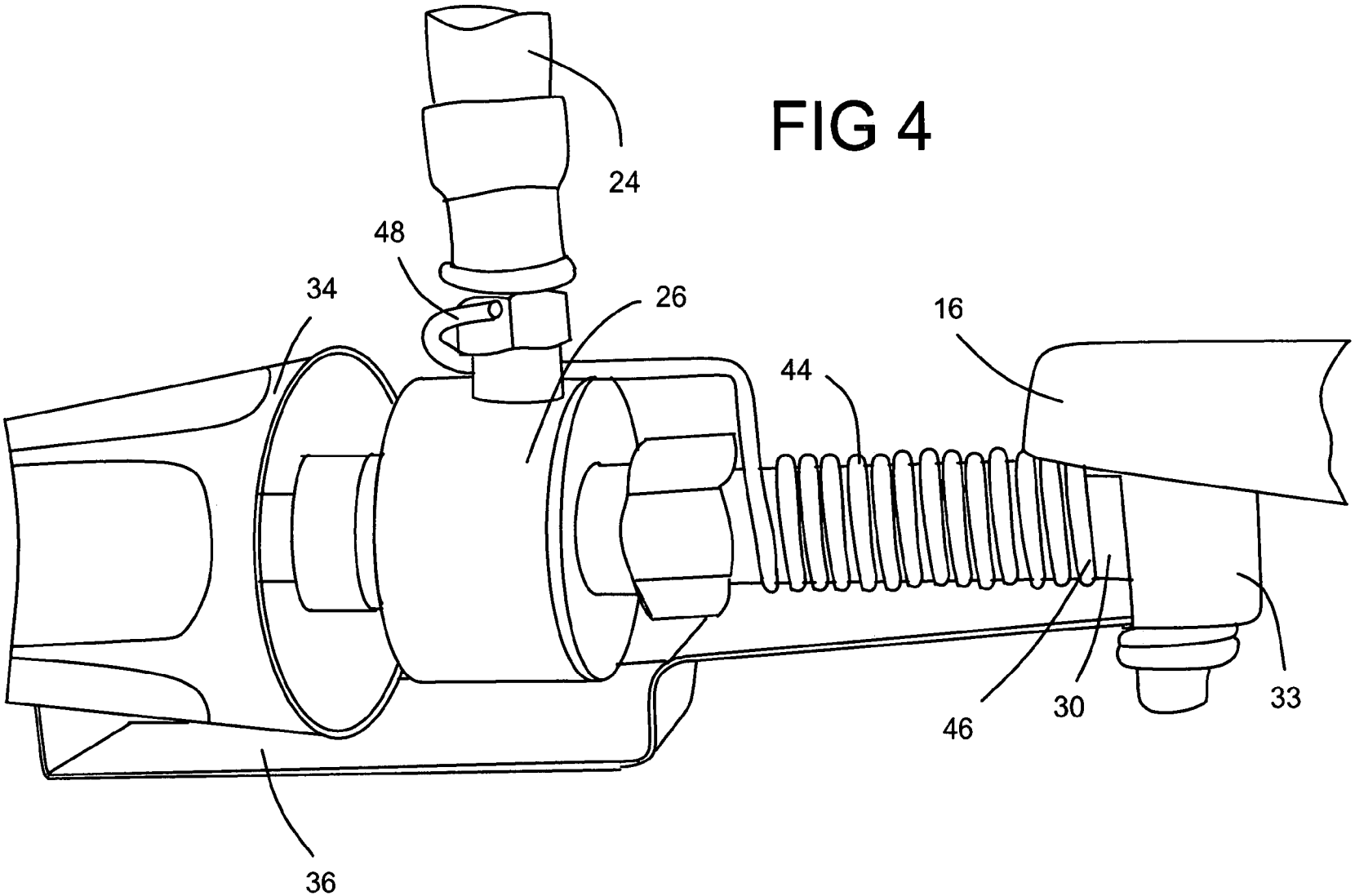
FIG. 4 is a side elevational view of the elements shown in FIG. 3.

Referring now to the drawings and particularly to FIG. 1, a standard toilet fixture 10 supports a bidet shown generally as 12 primarily on the underside 14 of seat 16 shown fully in FIG. 2. A part of the bidet extends from beneath seat 16 in FIG. 1. Main water line 18 extends from the entry wall 20 to the toilet tank 22. A water supply line 24 taps main line 18 as shown and extends to a two-way valve 26 as shown in FIG. 4.

Valve 26 connects with a first end 28 of a bidet hoop conduit shown generally as 30. Hoop conduit 30 extends around the back of openings 32 on the other side of seat 16 and then ends as a formed lever 32. A nozzle 31 is formed midway of opening 15 50 it will be in a proper position to deliver a mist of warm water to the desired area of the user. Clips 33 secure hoop conduit 30 to seat underside 14.

Hoop conduit 30 in FIG. 2 is in a first position substantially flat against the seat underside 14 in an inactive or off condition. When it is to be activated, lever 32 is pulled rearwardly so that hoop conduit 30 moves to a second position below seat opening 32. Not that there is some adjustability in the location of the second position depending upon what area the user intends to treat.

Valve 26 is operably connected to a handle 34. When valve 26 moves with respect to haridle 34, the valve-to-handle relationship changes going from either an "open" condition allowing water to pass from member 24 through valve 26 and into hoop conduit 30 or to a "closed" condition terminating water flow through valve 26. A securing member 36 is connected at one end 38 to the underside 14 of seat 16 and at the other end to handle 34 by a screw 42. With this arrangement, handle 34 always remains stationary and valve 26 rotates with movement of hoop conduit 30.

A spring 44 encircles hoop conduit 30 and is fixedly secured at one end to hoop conduit 30. The other end 48 of spring 44 attaches to water supply line 24 as shown in FIG. 4. When hoop conduit 30 is in the first position against the underside 14 of seat 16, spring 44 is relaxed. When hoop conduit 30 moves to the second position, spring 44 is flexed and under tension since valve 26 has rotated about 90 degrees with respect to handle 34. When the user releases lever 32, the tensioned spring 44 releases and moves hoop conduit 30 back to the "closed" position without user assistance.

Figure 5:
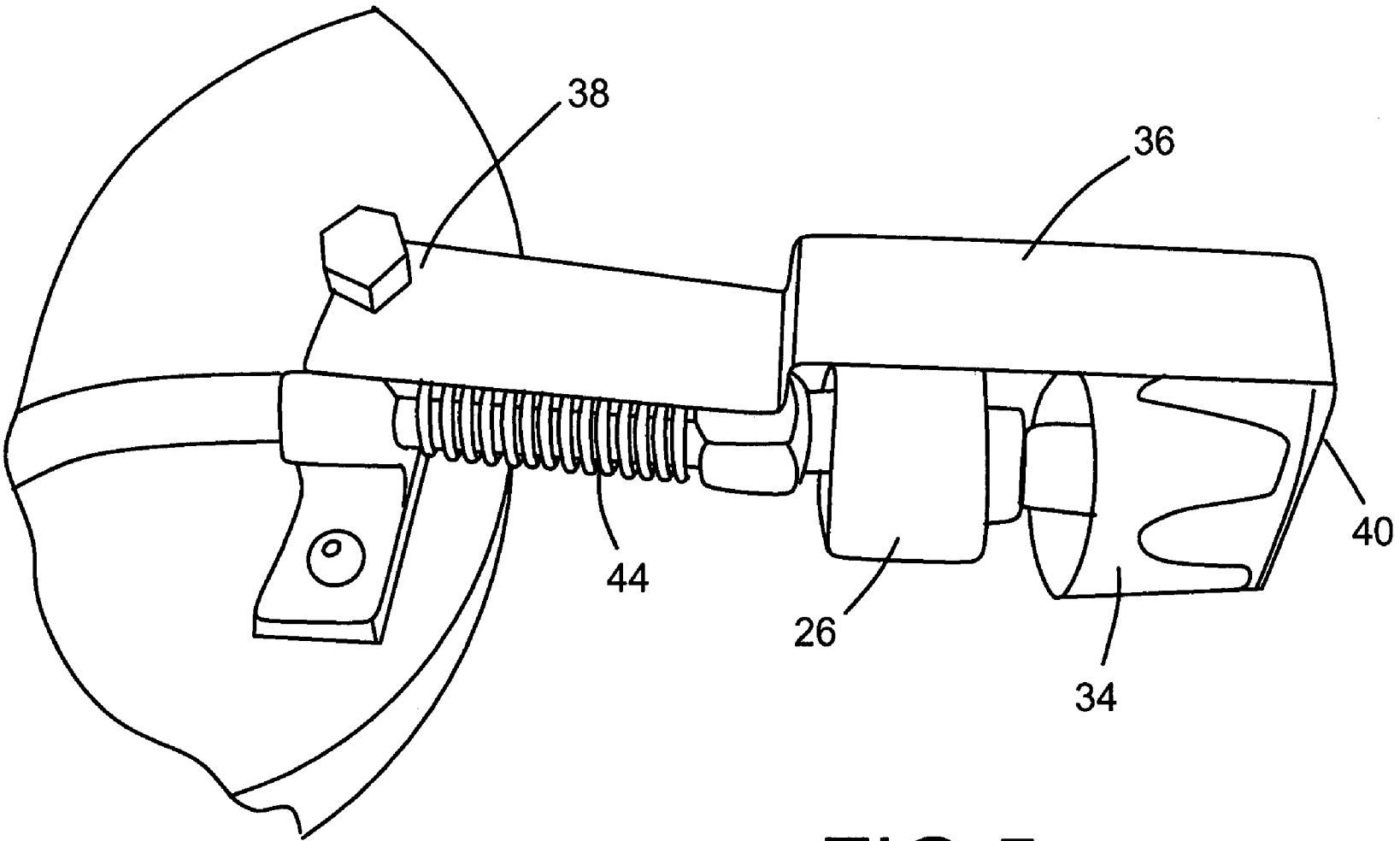
FIG. 5 is a side elevational, perspecfive view of the other side of the elements shown in FIGS. 3 and 4.
Figure 6:
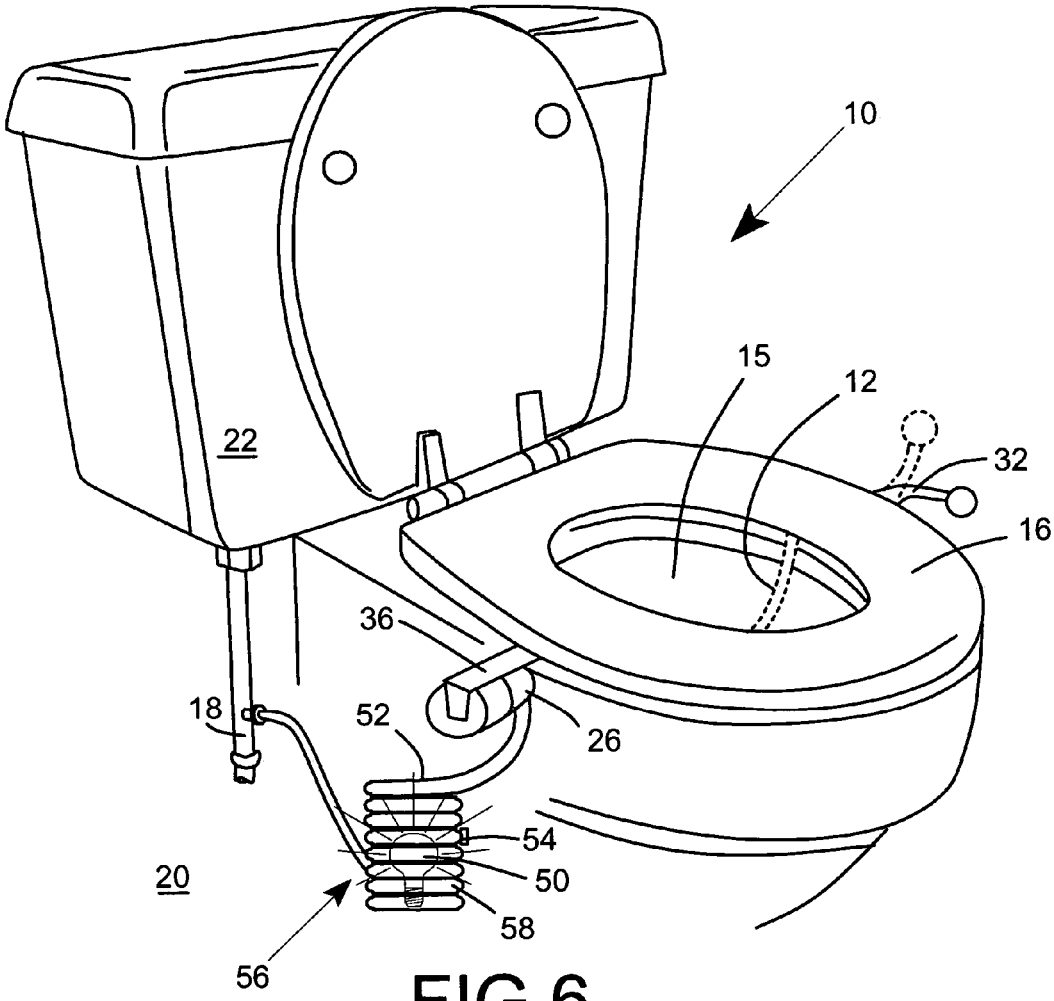
FIG. 6 is a perspective and partial view of the device of the present invenfion wherein a heating coil and a lamp have been included to assure a suppiy of warm water.

An additional feature of the present invention is the addition of a water warmer shown generally as 56 in FIG. 5 made up of a spiral wound pipe coil 58 surrounding a light 50 to heat the water in coil 58. Insulation can be applied around the coil periphery and over the coil top 52 to enhance water heating. A thermostat 54 is included to turn off the light when the temperature reaches a preselected level.

The invention claimed is:

1. A toilet/bidet device connected to a seat of a toilet for cleaning a user's genitals and posterior side, the toilet/bidet seat comprising: a water supply conduit connectable to a main water line supplying water to the toilet; a bidet hoop conduit positioned on the underside of the seat having first and second ends, the second end forming a lever, the bidet hoop conduit being selectively movable by the lever from a first position substantially flat against the underside of the seat to a second position extending below a recess in the seat; a nozzle connecting with the bidet hoop conduit; a valve connecting the bidet hoop conduit and having first and second ends, the first end connecting the main water line and the second end connected to the bidet hoop conduit; a handle; and a securing member having first and second ends, the first end connecting with the toilet seat and the second end secured to the handle wherein rotation of the lever rotates the bidet hoop conduit from the first to the second position and also rotates the valve with respect to the handle and thereby opens the valve during rotation of the bidet hoop conduit from the first position to the second position and permits water to flow from the main water line into the bidet hoop conduit and out of the nozzle and wherein movement of the lever moves the bidet hoop conduit from the second position to the first position, rotates the valve with respect to the handle and terminates the flow of water from the main water line to the bidet hoop conduit and nozzle.

2. The toilet/bidet device as claimed in claim 1 further comprising: a spring over the first end of the bidet hoop conduit and secured to the toilet seat and the second end secured to the water supply conduit wherein movement of the lever and the bidet hoop conduit, relative to the handle, from the first position tensions the spring and wherein release of the lever releases the tension in the spring and moves the bidet hoop conduit from the second position to the first position.

3. The toilet/bidet device as claimed in claim 2 wherein the nozzle is positioned midway of the bidet hoop conduit.

4. The toilet/bidet device as claimed in claim 2 further comprising: a water warmer for heating the water moving from the main water line to the valve.

5. The toilet/bidet device as claimed in claim 1 wherein the nozzle is positioned midway of the bidet hoop conduit.

6. The toilet/bidet device as claimed in claim 5 further comprising: a water warmer for heating the water moving from the main water line to the valve.

7. The toilet/bidet device as claimed in claim 4 wherein the water warmer comprises a spiral wound pipe coil positioned within the water supply conduit going to the bidet hoop conduit and a warming light placed within the spiral wound pipe coil.

8. The toilet/bidet device as claimed in claim 1 further comprising: a water warmer for heating the water moving from the main water line to the valve.

9. The toilet/bidet device as claimed in claim 8 wherein the water warmer comprises a spiral wound pipe coil positioned within the water supply conduit going to the bidet hoop conduit and a warming light placed within the spiral wound pipe coil.

10. The toilet/bidet device as claimed in claim 9 wherein the water warmer includes a thermostat to cut off the warming light when the water temperature reaches a preset level.

11. A bidet device for use on a toilet, the bidet device comprising a bidet conduit assembly mountable on a toilet seat and a valve subassembly:

the bidet conduit assembly comprising: a bidet hoop conduit mountable on an underside of the toilet seat; a lever on one end of the bidet hoop conduit for rotating the bidet hoop conduit, and a nozzle intermediate opposite ends of the bidet hoop conduit, the lever moving the bidet hoop conduit and the nozzle from a retracted position beneath the underside of the toilet seat on which the bidet device is mountable to an operative position below a toilet seat opening;

the valve subassembly being located on an opposite end of the bidet hoop conduit and comprising: a support member attachable to the toilet seat; a valve communicating with the bidet hoop conduit and rotatable between an open and a closed position during rotation of the bidet hoop conduit, the valve being opened and closed by movement of the lever on the bidet hoop conduit; and a water supply conduit extending from the valve and attachable to a main water line;

wherein movement of the bidet hoop conduit and water flow through the nozzle are controllable only by a single rotary movement of a single lever on the bidet hoop conduit.

12. A bidet assembly for use on a toilet upon replacement of a toilet seat with a toilet seat/bidet apparatus, the toilet seat/bidet apparatus including a toilet seat with a bidet subassembly attached thereto, the bidet subassembly comprising;

a bidet conduit assembly comprising: a bidet hoop conduit mounted on an underside of the toilet seat; a lever on one end of the bidet hoop conduit for rotating the bidet hoop conduit, and a nozzle intermediate opposite ends of the bidet hoop conduit, the lever moving the bidet hoop conduit and the nozzle from a retracted position beneath the underside of the toilet seat on which the bidet device is mounted to an operative position below a toilet seat opening;

the valve subassembly being located on an opposite end of the bidet hoop conduit from the lever and mounted on the toilet seat and comprising: a support member attached to the toilet seat; a valve communicating with the bidet hoop conduit and rotatable between an open and a closed position in response to rotation of the bidet hoop conduit, the valve being opened and closed by movement of the lever on the bidet hoop conduit to rotate the bidet hoop conduit; and a water supply conduit extending from the valve and attachable to a main water line;

wherein movement of the bidet hoop conduit and water flow through the nozzle are controllable only by a single movement of a single lever on the bidet hoop conduit.

* * * * *